United States Patent [19]

Killpatrick et al.

[11] 4,208,024

[45] Jun. 17, 1980

[54] CONTROL APPARATUS

[75] Inventors: Joseph E. Killpatrick, Minneapolis, Minn.; Ralph D. Ormsby, Ann Arbor, Mich.

[73] Assignee: Honeywell Inc., Minneapolis, Minn.

[21] Appl. No.: 82,123

[22] Filed: Jan. 11, 1961

[51] Int. Cl.[2] ..... F41G 7/00

[52] U.S. Cl. ..... 244/3.15; 343/113 R

[58] Field of Search ..... 244/14, 77 B, 77 D; 343/107, 108, 112, 117

[56] References Cited

U.S. PATENT DOCUMENTS 2,179,570 11/1939 Zublin ..... 343/107

OTHER PUBLICATIONS

Lytel, *UHF Practices and Principles*, 1953, p. 42.
*Radio Amateur's Handbook*, 31st Edition, 1954, p. 15.
Keen, *Wireless Direction Finding*, 1947, p. 13.

*Primary Examiner*—David H. Brown
*Attorney, Agent, or Firm*—Charles J. Ungemach

EXEMPLARY CLAIM

13. In a control system by means of which a dirigible craft may be controlled, means on said craft for detecting electric fields through which said craft may be moving and for producing three signals indicative of orthogonal components of the electric field detected thereby; first and second computing networks each comprising input means and output means; and means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of the product of magnitude of the smaller of the signals applied thereto and a trigonometric function of the phase angle between the signals applied thereto.

16 Claims, 9 Drawing Figures

CONTROL APPARATUS

This invention relates to the field of control apparatus and more specifically to apparatus relating to a control system by means of which a dirigible craft may be controlled. The invention pertains to apparatus for detecting electric fields through which a dirigible craft may be moving, for producing signals indicative of the electric field, and for utilizing the signals in a manner by means of which the craft may be controlled.

The present invention is an improvement over the co-pending application of Lawrey H. Chapin and Robert O. Maze entitled "Control Apparatus", Ser. No. 14,164, filed Mar. 4, 1960, now abandoned, and assigned to the same assignee as the present invention.

The present invention provides means on a dirigible craft which serve the function of detecting electric fields through which the craft may be moving and for producing three signals indicative of orthogonal components of the electric field so detected. The invention also provides a first and a second computing network each of which comprises input means and output means. The first and the second of the signals from the detecting and signal producing means are applied to the input means of one of the networks. The second and the third of the signals are applied to the input means of the other network. The networks are characterized by producing output signals at the output means thereof indicative of a function of the input signals applied thereto. The invention further provides means connected to the network output means to receive the output signals thereof and adapted to supply a control signal indicative of the function of the output signals by means of which the dirigible craft may be controlled.

The present invention has specific application to a control system by means of which a dirigible craft may be controlled relative to the electric field produced by a high voltage transmission line. The invention provides a means by which the direction of the line relative to the aircraft may be ascertained as well as the distance of the dirigible craft from the line. It will be understood that this information may advantageously be utilized for controlling the dirigible craft. A system of this type broadly has been disclosed and claimed in said co-pending application, Ser. No. 14,164. The present invention provides an improvement over said co-pending application, the improvement consisting of a new combination of elements which collectively constitute a much simpler system than that disclosed in said co-pending application. The present invention provides a unique computing mechanism which forms a vital part of the new combination. Generally the computing mechanism, of which there are two in the invention, perform the function of receiving at the inputs thereof two alternating signals indicative of two out of the three alternating signals which in turn are indicative of the orthogonal components of the electric field through which the dirigible craft may be moving. The computing networks are characterized by producing an output signal of a unidirectional nature, the polarity of which is determined by the relative phase angle between the two signals applied thereto and the magnitude of which is determined by the magnitude of the smaller of the two signals applied thereto and the cosine of the relative phase angle therebetween.

Another advantage of the present invention is that it provides a means for computing the relative bearing and distance of a transmission line relative to a dirigible craft regardless of anomalies associated with the power line. Such anomalies can occur at line terminations, line transpositions, line crossings, and deviations in the line from a straight line such as turns.

The present invention also has applicability to a low altitude system, navigation relative to a line at low altitude presenting a different problem from that associated with navigation at higher altitudes.

It is an object of this invention therefore to provide an improved control system by means of which a dirigible craft may be controlled.

Another object of the invention is to provide an improved computer mechanism for use on a dirigible craft so as to compute the relative bearing and direction of the dirigible craft with respect to a transmission line.

Another object of the invention is to provide apparatus for computing the relative bearing and distance of a transmission line relative to a dirigible craft regardless of anomalies associated with the power line.

Still another object of the invention is to provide improved low altitude apparatus for use on a dirigible craft by means of which the dirigible craft may be controlled relative to a transmission line.

The above and other objects will be understood more clearly and fully from the following detailed description and appended claims in conjunction with the accompanying drawing in which:

In the co-pending application, Ser. No. 14,164, there is a detailed discussion of transmission line characteristics and more specifically concerning the electric fields associated with a transmission line. Briefly, electric fields surrounding an electric transmission line such as a three-phase alternating current transmission line may be represented at any given point in space by an electrical vector rotating in space as a function of time, the rotation occurring in a plane generally perpendicular to the length of the line. Said co-pending application points out that by use of suitably oriented sensors on a dirigible craft, the electric field vector at any particular point in space may be resolved into its horizontal and vertical components. The co-pending application provides an apparatus for producing three alternating signals indicative of the orthogonal components of the electric vector field through which the dirigible craft may be moving. More specifically the detecting and signal producing means produces three orthogonal signals, one of which is indicative of the vertical component of the electric field and the other two of which respectively indicate the horizontal or lateral components of the electric field, the primary coordinate system being the three axes of the dirigible craft such as the roll, pitch and yaw axes of an aircraft.

Figure 1A:
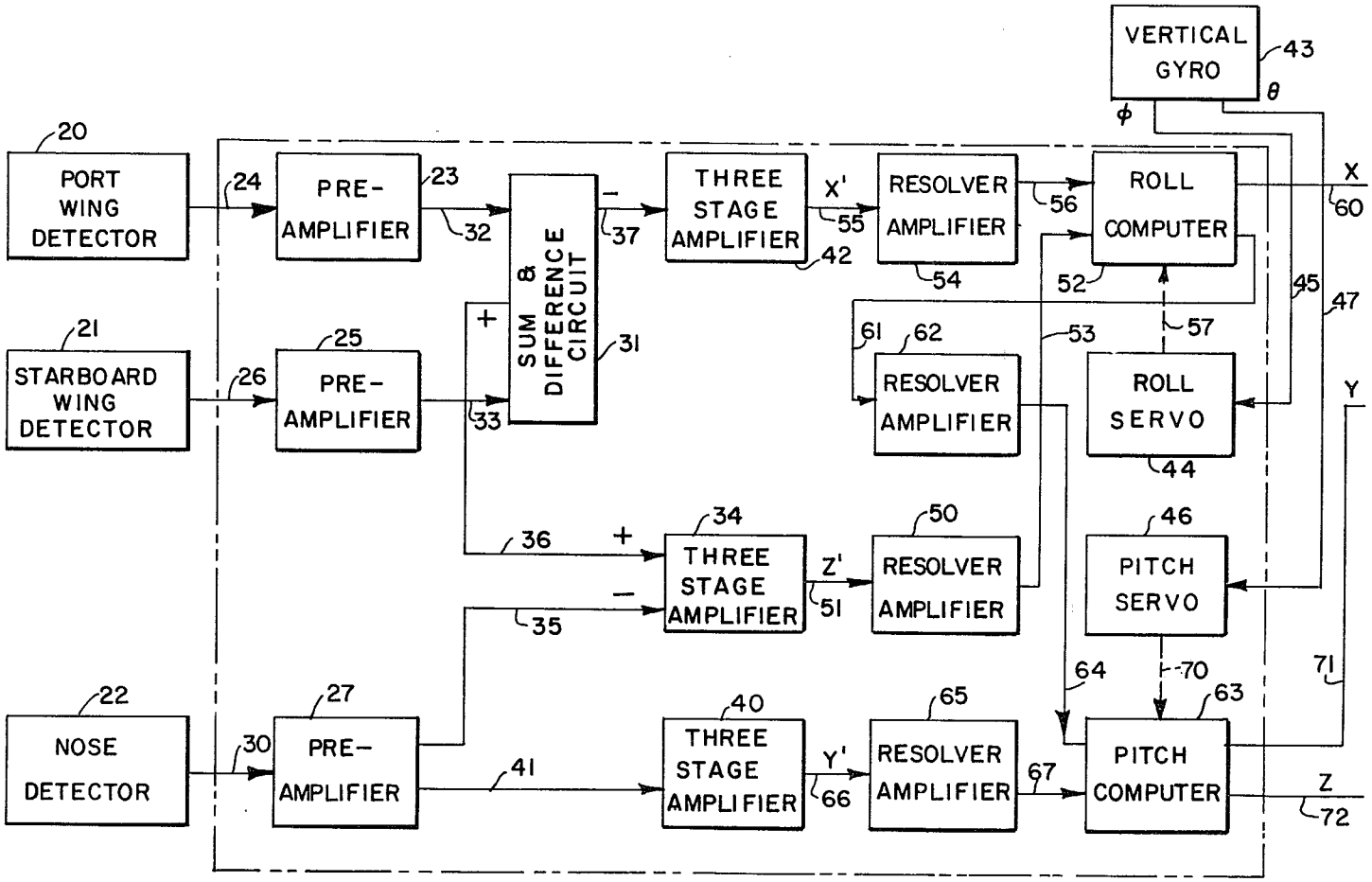
FIG. 1A is a block diagram showing an apparatus for detecting electric fields through which a dirigible craft may be moving and for producing three alternating signals indicative of orthogonal components of the electric field detected thereby.

In FIG. 1A is depicted one arrangement for producing three alternating signals indicative of the orthogonal components of the electric field through which the dirigible craft may be moving. The apparatus includes three detecting devices: a port wing detector 20, a starboard wing detector 21, and a nose detector 22. The detectors 20, 21 and 22 may be of any suitable type known to those skilled in the art of measuring electric field gradients. For example, the detectors each may take the form of a parallel plate type capacitor, the plates of the capacitor being separated a known distance by a dielectric and the detectors functioning simply by having the plates of the capacitor connected across the input of its associated preamplifier, to be described below. To explain, if an electric field gradient exists between the two plates or elements of the detector, then a voltage differential will exist between the plates, the magnitude of which is indicative of the electric field gradient. This voltage then may be applied to the preamplifier means. This type of electric field gradient detector is readily understandable by one skilled in the art. Further reference may be made to page 42 of *UHF Practices and Principles,* First Edition, by Lytel. It is not necessary that the two elements of the capacitor be immediately adjacent to one another; in fact, widely spaced apart elements may also be used. For example, one element may be mounted on one part of a dirigible craft and another element may be mounted on another part of the craft, the two elements being insulated from one another. The difference in potential or voltage between the two elements then is indicative of the potential gradient along the axis defined by the two elements. These detectors are respectively connected by suitable connection means 24, 26 and 30 to preamplifier means 23, 25 and 27, respectively. A sum and difference computing circuit means 31 is provided and is adapted to receive the outputs of preamplifiers 23 and 25 by means of leads 32 and 33 respectively. The sum and difference means 31 produces a difference or lateral (X') signal at a first output lead 37 thereof. The sum and difference means 31 also produces a summation signal or vertical (Z') signal at a second output lead 36 thereof. The difference signal X' is applied from output lead 37 of the sum and difference circuit to a three-stage amplifier means 42 and thence by means of a connection lead 55 to a resolver amplifier 54, the output of which is applied by a lead 56 to a first input of a roll computer 52. The summation or Z' signal from a sum and difference circuit 31 is applied by means of lead 36 to a three-stage amplifier 34 which also receives an input from the preamplifier 27 by means of lead 35. A second output lead from the preamplifier 27 identified by reference numeral 41 couples the preamplifier 27 to a three-stage amplifier 40. The output from the amplifier 34 is applied by a means of a lead 51 to a resolver amplifier 50 and the output from the amplifier 40 is applied by means of a lead 66 to a resolver amplifier 65. Amplifiers 50 and 65 have output leads 53 and 67 which are respectively connected to the roll computer 52 and to a pitch computer 63.

A vertical gyro 43 of any suitable type is provided and is adapted to provide at an output lead 45 thereof a signal indicative of the roll of the dirigible craft. At a second output lead 47 thereof it is adapted to produce a signal indicative of the pitch of the craft. A roll servo 44 and a pitch servo 46 are provided and are connected by means of leads 45 and 47 to the vertical gyro and are adapted to receive the roll signal and pitch signal respectively. The roll servo is connected by a suitable mechanical connection 57 to the roll computer 52 and the pitch servo is connected by means of a suitable mechanical connection 70 to the pitch computer 63. The roll computer 52 has a pair of output leads 60 and 61. At output lead 60 appears a signal designated as X in FIG. 1A which is indicative of one of the horizontal components of the electric field detected by the dirigible craft; proper compensation being made for the roll angle of the craft. The second output lead 61 has a signal impressed thereon indicative of the output of the roll computer and this signal is applied to a resolver amplifier 62 which has an output lead 64 thereof also connected to the pitch computer 63. The pitch computer 63 has a pair of output leads 71 and 72 which have impressed thereon respectively a pair of output signals designated in FIG. 1 as Y and Z which respectively are indicative of the other horizontal component of the electric field through which the craft may be moving and the vertical component of the same electric field.

Figure 2:
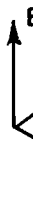
FIG. 2 is an orthogonal representation of the three alternating signals produced by the apparatus of FIG. 1A.

A more detailed description of the apparatus disclosed in FIG. 1A may be obtained from said co-pending application, Ser. No. 14,164. To briefly review, the apparatus disclosed in FIG. 1A produces three alternating signals X, Y and Z indicative of orthogonal components of the electric field through which the dirigible craft may be moving. It will be understood that the other arrangements may be used in combination with the present apparatus for producing the three alternating signals. A clear understanding of the signals X, Y and Z may be obtained by reference to FIG. 2 wherein the signals are orthogonally represented. It will be understood that in this explanation the signals are basically referenced to the axes of the dirigible craft such as the yaw, pitch and roll axes of an aircraft.

Figure 1B:
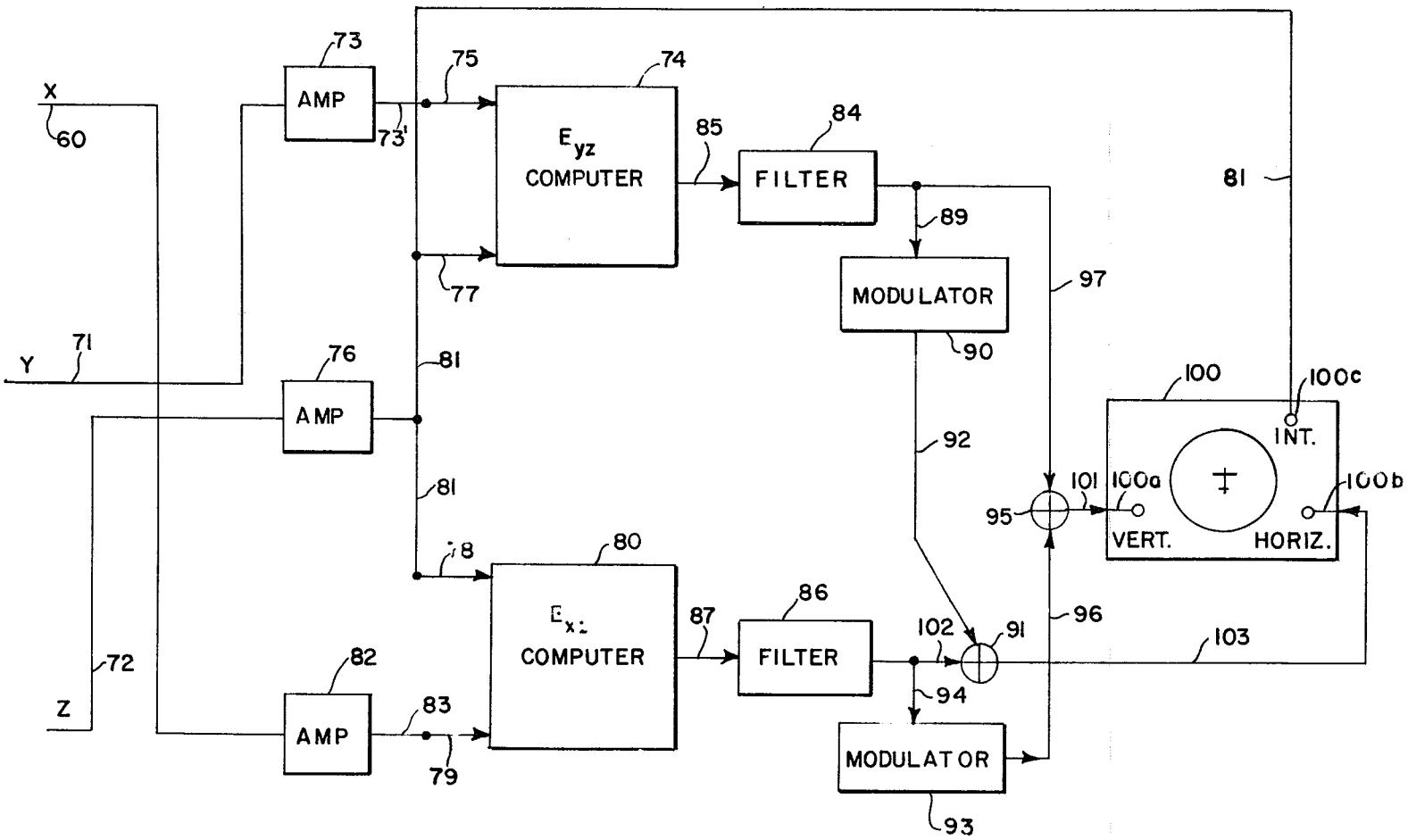
FIG. 1B is a block diagram of the apparatus for receiving the three alternating signals produced by the apparatus of FIG. 1A representative of the electric field and for displaying the relative distance to the line and the relative bearing of the line with respect to the dirigible craft.

Referring now to FIG. 1B, the leads 60, 71, and 72, previously identified in connection with FIG. 1A are depicted at the left hand portion of the figure. These leads are respectively connected to conventional amplifiers 82, 73 and 76. A pair of computers 74 and 80 are depicted in block form and will be described in considerably more detail below. For the time being the computers will be described merely as having a pair of inputs and an output. More specifically computer 74 which also is identified as the $E_{YZ}$ computer has a pair of inputs 75 and 77 and computer 80 which also is identified as the $E_{XZ}$ computer has a pair of inputs 78 and 79. The computer outputs of the computers 74 and 80 are respectively identified by reference numerals 85 and 87. The Y output from amplifier 73 is applied to a suitable connection lead 73' thereof which in turn is connected to input 75 of $E_{YZ}$ computer 74. The Z output of the amplifier 76 is applied by means of a suitable connection lead 81 to both the input 77 of the $E_{YZ}$ computer 74 and the input 78 of the $E_{XZ}$ computer 80. The computer 80 also receives at input 79 thereof an X signal from amplifier 82, the connection therebetween being indicated by lead 83. Broadly speaking, each of the computers produces at its output lead thereof a signal which is a function of input signals applied thereto. More specifically, and as will be described in more detail below, each of the networks or computers 74 and 80 is adapted to receive two alternating signals and to produce a unidirectional output signal the polarity of which is determined by the relative phase angle between the two signals applied thereto and the magnitude of which is determined by the magnitude of the smaller of the two signals applied thereto and the cosine of relative phase angle therebetween. Therefore at output leads 85 and 87 appear unidirectional signals having predetermined characteristics as a function of the applied signals X, Y and Z. More specifically the output at lead 85 is a function of the Y and Z signals appearing at leads 71 and 72 and the output at lead 87 of the $E_{XZ}$ computer 80 is a function of the X and Z signals appearing at leads 60 and 72. The outputs at leads 85 and 87 are applied respectively to a pair of filters 84 and 86 of any suitable type. Filters 84 and 86 are also known as low-pass filters and are well known to those skilled in the art. The output from filter 84 is applied by means of a lead 89 to a modulator or chopper or vibrator 90 and by means of a lead 97 to a summing point 95. The output from filter 86 is applied by means of a lead 94 to a modulator or chopper or vibrator 93 and by means of a lead 102 to a summing point 91. The modulators 90 and 93 are conventional and well-known to those skilled in the art. Each has an output designated schematically in FIG. 1B as lead 92 for modulator 90 and lead 96 for modulator 93. Lead 92 is connected to summing point 91 while lead 96 is connected to summing point 95. Thus at summing point 91 are received a unidirectional signal indicative of $E_{XZ}$ plus an alternating signal indicative of a function of $E_{YZ}$. Further, at summing point 95 are received unidirectional signals indicative of a function of $E_{YZ}$ and also an alternating signal indicative of a function of $E_{XZ}$.

A means by which the dirigible craft may be controlled is provided, this being designated in FIG. 1B as an indicator 100. More specifically indicator 100 may be a conventional cathode ray type oscilloscope having a pair of beam deflection control input terminals as well as a so-called intensity or Z-axis control input. More specifically the beam deflection control terminals for the indicator 100 are designated in FIG. 1B by the reference numerals 100*a* and 100*b* while the Z axis or intensity control is designated by reference numeral 100*c*. Terminals 100*a* and 100*b* may also be identified respectively as a vertical beam deflection control input terminal and as a horizontal beam deflection control input terminal. The output from summing point 95 is coupled by means of a lead 101 to the vertical beam deflection control input terminal 100*a* while the output from summing point 91 is connected by means of a lead 103 to the horizontal beam deflection control input terminal 100*b*. Lead 81 connects the output of the Z amplifier 76 to the intensity control input terminal 100*c* for purposes which will be explained below.

Figure 3:
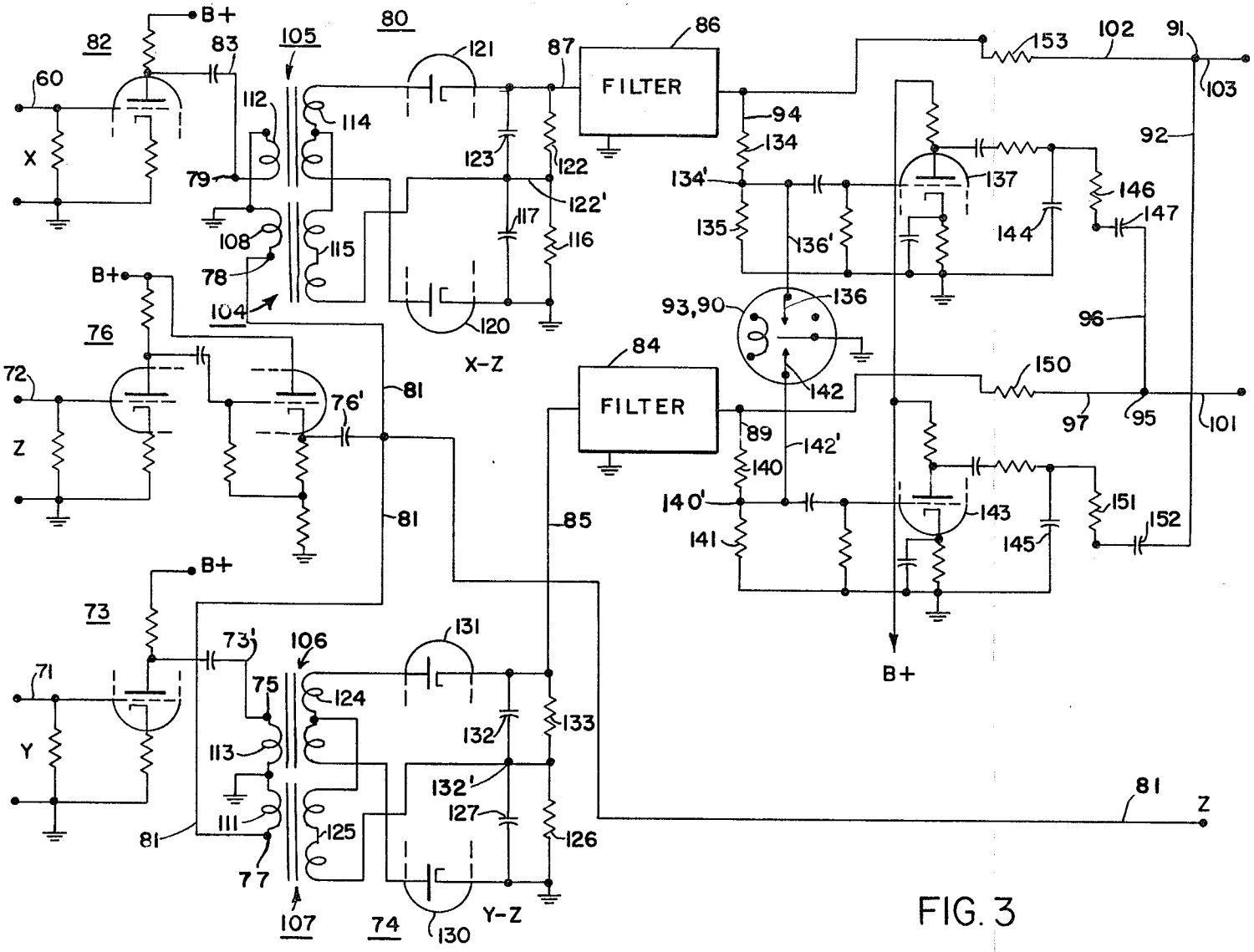
FIG. 3 is a schematic representation of the apparatus of block diagram form shown in FIG. 1B.

Referring now to FIG. 3, where the apparatus of FIG. 1B is shown in greater detail, the signal indicative of the electric field along the Z axis at lead 72 is amplified by a conventional two stage amplifier 76, the output of which is cathode coupled through a suitable connecting capacitor 76' and a lead 81 to a first input 78 of the $E_{XZ}$ computer 80. The $E_{XZ}$ computer 80 comprises in part a pair of transformers 104 and 105 having primary windings 108 and 112 and secondary windings 115 and 114 respectively. The primary windings 108 and 112 are each grounded at one end thereof and their other ends 78 and 79 constitute the two input terminals for the $E_{XZ}$ computer 80. As indicated the Z signal is applied through lead 81 to the first input 78 thereof. Further, the X signal appearing at lead 60 is amplified by a conventional one-stage amplifier and is coupled through a suitable condenser and a lead 83 to the second input terminal 79. Secondary winding 114 of transformer 105 is center tapped and the center tap in turn is connected to one end of secondary winding 115 of transformer 104. The two ends of secondary winding 114 are connected respectively to plate elements of a pair of suitable diodes 120 and 129. The cathode of diode 120 is grounded and the cathode of diode 121 is connected by lead 87 to the input of the filter 86. It will be noted that filter 86 is also grounded. A resistor 122 and a capacitor 123 are connected in parallel between lead 87 (or the cathode of diode 121) and a junction 122'. Another resistor 116 and a capacitor 117 are connected in parallel between junction 122' and the cathode of diode 120 which as indicated is grounded. As indicated one end of secondary winding 115 is connected to the center tap of secondary winding 114 of transformer 105. The other end of secondary winding 115 is connected through a suitable lead to the junction 122'.

The $E_{YZ}$ computer 74 comprises in part a pair of transformers 106 and 107 having primary windings 113 and 111 and secondary windings 124 and 125 respectively. The primary windings 113 and 111 each have one end thereof grounded and the other ends 75 and 77 thereof constitute two input terminals to the computer 74. The Z signal output from amplifier 76 is coupled through the coupling condenser 76' and lead 81 to terminal 77 of the computer. The Y signal appearing at lead 71 is amplified by a conventional single stage amplifier 73 and is coupled through a suitable condenser and a lead 73' to the other input terminal 75 of the computer 74. Thus signals indicative of the Y and Z signals are applied to the $E_{YZ}$ computer 74. The two ends of secondary winding 124 are respectively connected to the plate elements of a pair of suitable diodes 130 and 131. The cathode of diode 130 is grounded and the cathode of diode 131 is connected by a suitable lead 85 to the filter 84. It will also be noted that the filter means 84 is grounded. A capacitor 132 and resistor 133 are connected in parallel between the cathode of the diode 131 and a common junction point 132'. A resistor 126 and capacitor 127 are connected in parallel between the cathode of diode 130 and the junction point 132'. One end of the secondary winding 125 is connected to the center tap of the secondary winding 124 of transformer 106. The other end of the secondary winding 125 of transformer 107 is connected to the common junction point 132'.

The computers 74 and 80 are phase sensitive detectors and function when alternating signals are applied to the two input terminals thereof to produce unidirectional output signals, the polarity of which is determined by the relative phase angle between the two signals applied thereto and the magnitude of which is determined by the magnitude of the smaller of the two signals applied thereto and the cosine of the relative phase angle therebetween. Thus, in the case of the $E_{XZ}$ computer 80, signals indicative of the X and Z signals are applied from leads 60 and 72 through their associated amplifying means 82 and 76 to the two inputs 79 and 78 respectively. The computer 80 functions to have produced at its output lead 87 thereof a unidirectional signal, the polarity of which is determined by the relative phase angle between the X and Z signals and the magnitude of which is determined by the magnitude of the smaller of the X and Z signals and the cosine of the phase angle therebetween. Correspondingly the $E_{YZ}$ computer 74 has applied thereto a Y signal and a Z signal from amplifiers 73 and 76 respectively which are applied to input terminals 75 and 77 thereof. As unidirectional output signal is produced at the output lead 85 thereof, the polarity of which is determined by the relative phase angle between the Y and Z signals and the magnitude of which is determined by the magnitude of the smaller of the Y and the Z signals as well as the cosine of the relative phase angle therebetween.

The modulators 90 and 93 depicted separately in FIG. 1B are shown as a single unit in the detailed schematic in FIG. 3. As shown the modulator is a conventional electromechanical chopper having a center switch arm grounded and a pair of fixed contacts, identified respectively by reference numerals 136 and 142. The output from filter 86 is applied in part through a suitable lead 94 to a pair of series connected resistors 134 and 135, resistor 134 being connected to lead 94 and resistor 135 being grounded. The intermediate point 134' between resistors 134 and 135 is connected by a suitable lead 136' to one of the fixed contacts 136 of the chopper 90–93. The output from the filter 84 is applied in part through a lead 89 to a pair of series connected resistors 140 and 141. Resistor 140 is connected to lead 89 and resistor 141 is grounded. The intermediate point 140' between resistors 140 and 141 is connected through a suitable lead 142' to fixed contact 142 of the synchronous chopper 90–93. The operation of the chopper 90–93 is conventional in that the movable contact arm thereof which is grounded alternately engages first one of the fixed contacts and then the other. Thus part of the time fixed contact 136 is grounded and simultaneously contact 142 is ungrounded and part of the time the reverse situation exists, namely with fixed contacts 142 grounded and fixed contact 136 ungrounded. Thus, as is well understood, the unidirectional signals appearing at junction points 134' and 140' are chopped so as to become alternating in nature. These alternating signals are then coupled through suitable single stage amplifiers including triodes 137 and 143. The output of the amplifier including the triode 137 is coupled through a resistor 146, a capacitor 147, and lead 96 to the junction point 95. The amplifier further includes a capacitor 144 connected between one end of the resistor 146 and ground for noise attenuating purposes. Thus the unidirectional signal at junction point 134', which is indicative of the output of the $E_{XZ}$ computer 80, is converted into an alternating voltage which is then amplified and applied to the junction point 95. Simultaneously the output from the filter 84 is applied from the filter 84 through a series resistor 150 and the coupling lead 97 to the junction point 95. Thus at junction point 95 and at lead 101 connected thereto is produced a composite signal representing the summation of the unidirectional signal output of the filter 84 which is indicative of the output of the $E_{YZ}$ computer 74 as well as an alternating voltage indicative of the output of the $E_{XZ}$ computer 80.

The amplifier which includes the triode 143 is coupled through a series arrangement of a resistor 151 and a capacitor 152 and a lead 92 to the junction point 91. This amplifier also has a capacitor 145 connected from one end of the resistor 151 to ground for noise attenuating purposes. The input to the amplifier including the triode 143 is the junction point 140' which is indicated as connected to the filter 84 associated with the $E_{YZ}$ computer 74. The signal at junction 140' is chopped in the manner above described and thus constitutes an alternating signal which is amplified by the triode 143 and is applied through lead 92 to the junction point 91. Simultaneously at junction point 91 is applied the unidirectional signal indicative of the $E_{XZ}$ computer 80 through a suitable coupling resistor 153 and lead 102 from the filter 86. Thus at lead 103 connected to junction point 91 is a composite signal constituting a unidirectional signal indicative of the X and Z inputs to the computer together with an alternating signal or second modulated signal indicative of the X and Z signals.

The apparatus depicted in FIG. 3 may also be summarized by identifying the signal which appears at lead 96 as being a first modulated signal and that appearing at lead 92 as being a second modulated signal. The two modulated signals are modulated 180° out of phase with one another due to the inherent action of the chopper or modulator means 90–93. The first and second modulated signals appearing at leads 96 and 92 respectively are thus combined with the outputs from the computer networks 80 and 74 respectively.

As above described the indicator 100 depicted in FIG. 1B has a pair of beam deflection control input means namely terminals **100*a* and 100*b* which more specifically in FIG. 1B are respectively identified as the vertical input and as the horizontal input. The lead 103 is connected between the common junction point 91 and one of the beam deflection control input means namely terminal 100*b* while lead 101 is connected to the second of the beam deflection control means 100*a*. The apparatus depicted functions so that the unidirectional output signal appearing on lead 102 being connected to the vertical deflection circuits of the oscilloscope 100 will deflect the beam of the cathode ray tube to a position which is indicative of the relative forward or rearward distance of the aircraft or dirigible craft to the transmission line. Further the apparatus functions so that the unidirectional signal appearing at lead 97 and which in turn is applied to the horizontal deflection circuit of the cathode ray tube will cause the beam thereof to move to the left or right of the center of the cathode ray tube and thereby display the relative lateral distance of the line from the dirigible craft. The unidirectional signal on lead 94 as modulated by modulator 93 is applied through lead 96, junction 95, and lead 101 to the vertical deflection control terminal 100*a* generating or causing an oscillating vertical deflection of the beam, the magnitude of the oscillations indicative of the magnitude of the signal at lead 94. In the same manner the unidirectional signal on lead 89 is modulated by modulator 90 and applied as an oscillatory input to the horizontal beam control input terminal 100*b***. The two unidirectional signals therefore serve to position the beam at a point on the face of the indicator indicative of the direction and position of the line relative to the aircraft. Simultaneously the two modulated (alternating) signals function to control the beam to form a line on the face of the indicator. The center of the line so formed is defined by the two unidirectional signals.

Figure 7:
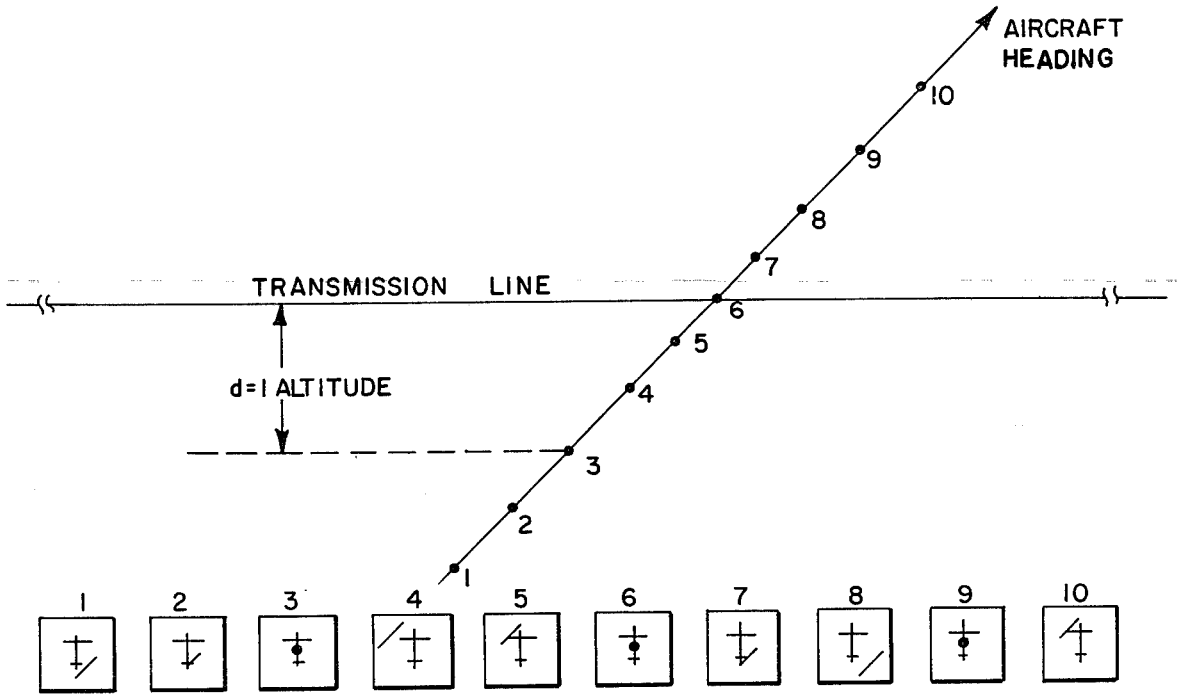
FIG. 7 is a pictorial view of a typical indicator which may be used with the present invention showing the sequence of views which would be presented to an observer at various stages of a dirigible craft crossing a transmission line.

Further, the line so formed is oriented perpendicular to a line joining the point defined by the two unidirectional signals and the center of the face of the indicator. Further, the length of the line is a function of the vectorial sum of the magnitudes of the two alternating signals. Thus in general, the length of the line displayed on the indicator will be indicative of the distance between the aircraft and the transmission line. Typical presentations of an indicator are shown in FIG. 7, the ten different indicator views corresponding to ten different positions of a dirigible craft relative to a transmission line. FIG. 7 may be likened to a plan view of the earth with the transmission line extending from the left to the right and with the dirigible craft being on a course which angles across the line, the dirigible craft at position 6 being directly over the line.

Modulation of the cathode ray tube beam intensity as a function of the magnitude of the vertical component of the electric field will give a positive indication of the dirigible craft being directly over the transmission line. Generally speaking the vertical component of the electric field maximizes when the dirigible craft is directly over the line and accordingly a signal indicative of this coupled into the intensity control of the cathode ray tube will give a positive indication of this occurring. Referring again to FIG. 7, as the aircraft first approaches the transmission line the presentation on the indicator 100 as depicted in the insert 1 tends on the one hand to be misleading since the aircraft symbol which may merely be a fixed indicia on the face of the cathode ray tube appears to have the transmission line behind it. In position 2 where the aircraft is somewhat closer to the transmission line the transmission line also appears to be behind the craft but not as far as in position 1. This information while being of a somewhat reverse sense still does impart to the human observer having knowledge of the computer's characteristics the fact that he is approaching the transmission line. At position 3 which is defined as being at a lateral distance d away from the transmission line equal to the altitude of the dirigible craft over the transmission line a unique situation occurs. At this point the transmission line instead of being represented as an elongated trace on the indicator is represented by a dot which is centered directly under the aircraft. At position 4 the line again is depicted and this time appears to be ahead of the craft and off to the left. This then gives the human observer a correct presentation of the bearing of the line relative to the craft as well as the approximate distance of the craft from the line. Likewise in position 5 where the aircraft is getting quite close to the transmission line the presentation presented to the human observer at the scope indicates that the line is much closer than it was for position 4. At position 6 where the dirigible craft is directly over the line, the presentation is again unique, the line being designated by a single dot directly centered relative to the craft. The intensity of the spot at this point will be much greater than at position 3 which had a similar configuration due to the fact that the vertical signal maximizes over the line and is coupled into the intensity control through lead 81 and through terminal 100c of the oscilloscope. The heading and distance information at positions 7 and 8 is of correct sense analogous to that of positions 4 and 5. At position 9 which is the same distance d away from the transmission line as position 3 again a dot presentation is observed. The intensity of the dot will be substantially equal to that at position 3 and substantially less than at position 6. Beyond position 9 such as at position 10 and further away from the line a reversed presentation will be observed but, to the skilled observer, this will impart significant information.

Figure 4:
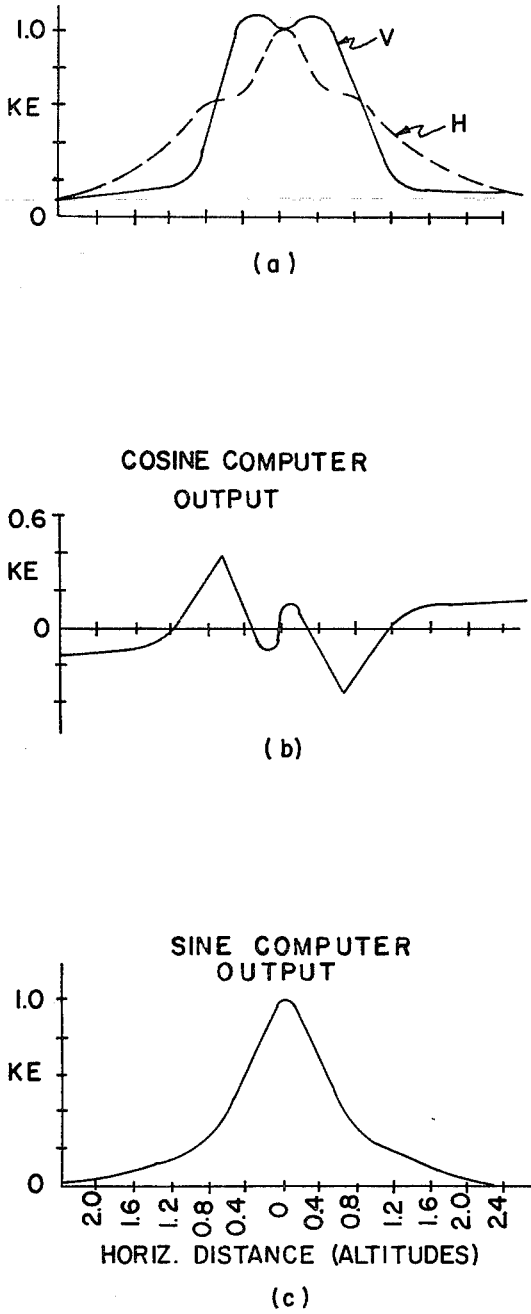
FIG. 4 is a representation of various signals computed or received by apparatus for low altitudes.
Figure 5:
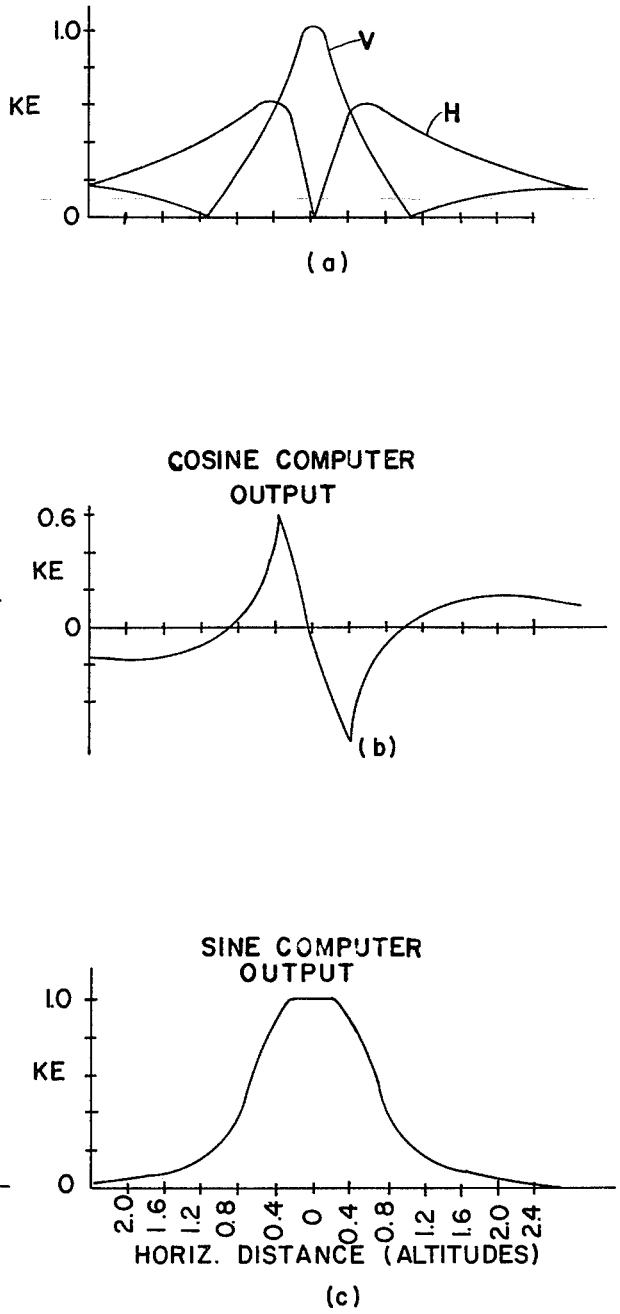
FIG. 5 is a representation of various signals computed or received by apparatus for high altitudes.

As indicated above, the electric field characteristics of the transmission line vary considerably according to the relative altitude of the dirigible craft over the line. It has been above indicated that for relatively low altitude operations an apparatus of somewhat different configuration than that for high altitude operation is needed in order to provide an efficient control system by means of which a dirigible craft may be controlled. FIGS. 4 and 5 depict various detected and computed signals which illustrate the above point. FIG. 4 is generally related to low altitude operation and FIG. 5 is generally related to high altitude operation. The expressions "low altitude" and "high altitude" are relative. In FIG. 4 the information depicted is indicative of signals detected and computed over a conventional three-phase transmission line and a relatively low altitude of 750 feet. FIG. 5, on the other hand, is information detected and computed over the same line at a relatively high altitude of approximately 75,000 feet. FIGS. 4*a* and 5*a* both depict the horizontal and vertical components of the electric field. The abscissas for all of the figures in FIGS. 4 and 5 are indicated for FIGS. 4*c* and 5*c* and are in distance units away from the line. More specifically, the distance units are in multiples of altitude units. It will be noted that in the high altitude case depicted in FIG. 5 the vertical component of the electric field maximizes in a very pronounced fashion when the dirigible craft is directly over the line. At the same time the horizontal field component minimizes and tends to go to zero. In the low altitude case the vertical component is at a high value directly over the line and on both sides thereof but is relatively unuseful for removing ambiguity in display by means of intensity control. The horizontal component to the contrary is useful since it maximizes directly over the line at low altitudes.

FIGS. 4*b* and 5*b* generally depict the cosine computer output, the high altitude case depicted in FIG. 5*b* showing that as the aircraft crosses over the line there is a sharp change in the output from the cosine computer. This is a useful characteristic. In the low altitude case depicted in FIG. 4*b*, the output of the cosine computer is quite erratic near the line and accordingly the cosine computer is not too useful at this point. FIGS. 4*c* and 5*c* depict the output of a sine computer to be described below. It will be shown below that the sine computer is similar in many respects to the cosine computer with a few significant differences. The sine computer generally is very useful for the low altitude control mode of operation. FIG. 4*c* shows that the sine computer output maximizes over the line and rapidly decreases on both sides of the line. For the high altitude case depicted in FIG. 5*c* however the output of the sine computer is relatively flat for a considerable distance on both sides of the line and the magnitude is extremely low and accordingly is not useful.

One aspect of the present invention therefore is to provide a computing mechanism which may be used for relatively low-altitude operation, this combination comprising in part a so-called sine computer. Generally speaking the sine computer is similar to the cosine computer except that the inputs thereof are operated on a suitable means so that they are shifted by 90° with respect to one another as compared to similar inputs applied to the cosine computer described above and quite specifically depicted in FIG. 3. Briefly the cosine computer described above has an output proportional to the smaller of its two inputs and to the cosine of the phase angle therebetween. By shifting the inputs by 90° with respect to one another then the same computer can be used to give an output proportional to the smaller of its two inputs and the sine of the original phase angle therebetween.

Figure 6:
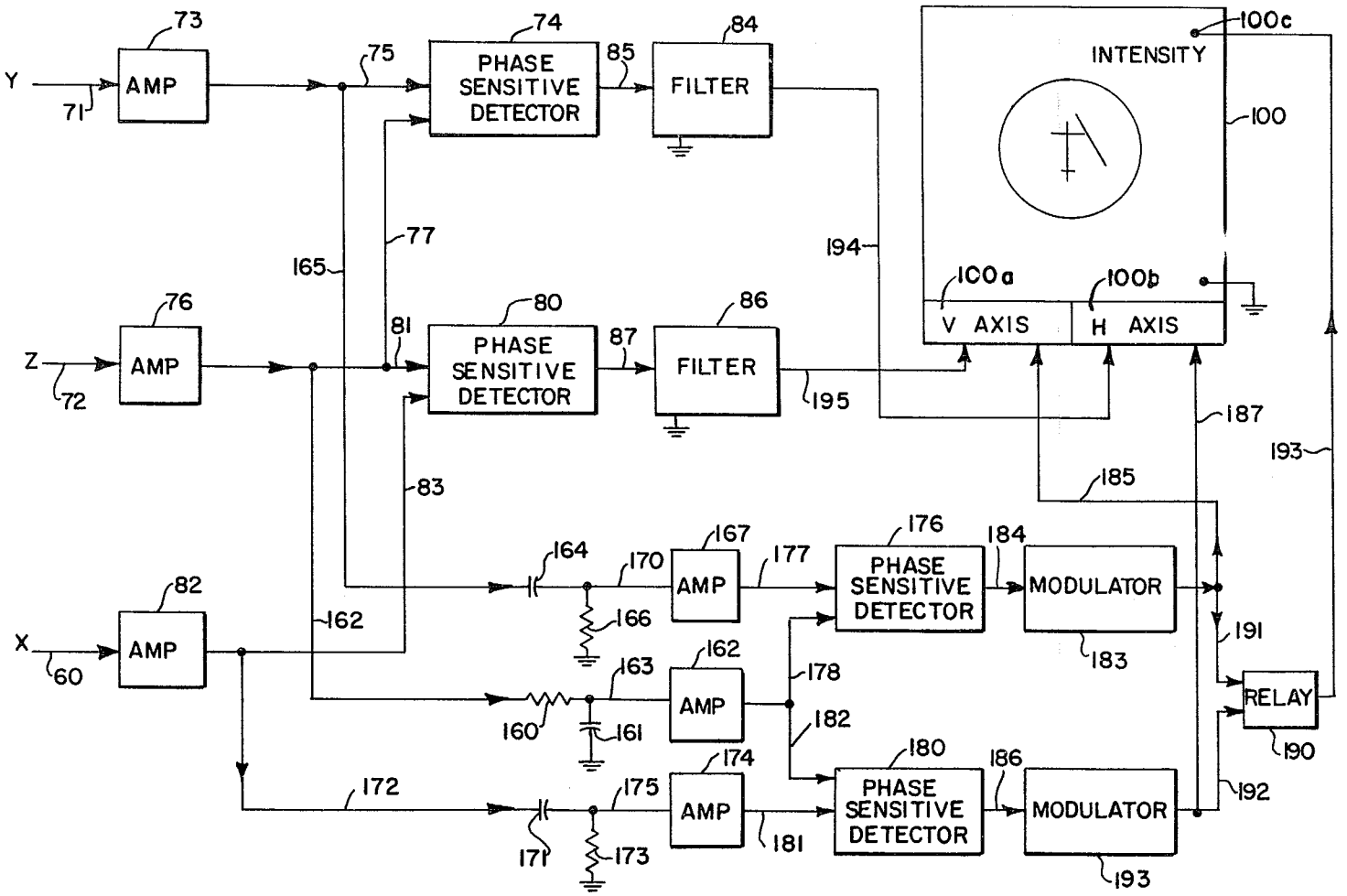
FIG. 6 is a block diagram of a low altitude computer.

A low altitude computing apparatus comprising in part sine computers is depicted in FIG. 6.

In FIG. 6 some elements depicted in general are the same as elements depicted in FIG. 1B and accordingly similar reference numerals are used for these elements. Thus preamplifiers 73, 76 and 82 are provided for respectively amplifying the Y, Z and X signals appearing at leads 71, 72 and 60. Also, an $E_{YZ}$ computer 74 is provided, being identified in FIG. 6 as a phase sensitive detector and correspondingly an $E_{XZ}$ computer 80 is provided also being identified in FIG. 6 as a phase sensitive detector. The outputs of these computers or detectors are applied through leads 85 and 87 respectively to filters 84 and 86. The outputs from the filters 84 and 86 are applied respectively to the vertical and horizontal beam deflection control input terminals of the indicator 100, these also being identified respectively as the V axis control and H axis control. More specifically a lead 194 is connected between filter 84 and the H axis control terminal 100*b* and a lead 195 connects the V axis input terminal 100*a* to the filter 86.

The apparatus depicted in FIG. 6 further comprises a pair of phase sensitive detectors or computers 176 and 180 which generally may be identical to the apparatus depicted in FIG. 3, each computer comprising in part a pair of transformers. Suitable means are provided for shifting the phase of the signals applied to the computers by a total of 90° as compared to similar signals being applied to the cosine computers. Any suitable phase shifting means may be used, the arrangements depicted in FIG. 6 comprising a capacitor resistor network coupling the outputs from the amplifiers 73, 76 and 82 to the phase sensitive detectors 176 and 180. More specifically a capacitor 164 and a resistor 166 are connected in series, resistor 166 being grounded at one end and capacitor 164 being connected to the output of amplifier 73 by a lead 165. The junction point between the capacitor 164 and the resistor 166 is connected by means of a lead 170 to a suitable amplifier 167 and the output thereof is applied by means of a lead 177 to phase detector 176.

A resistor 160 and a capacitor 161 are connected in series with one side of the capacitor 161 being grounded and one side of the resistor 160 being connected by means of a lead 162 to the output of amplifier 76. The common junction point between the capacitor 161 and the resistor 160 is connected by means of a lead 163 to a suitable amplifier 162 having a first output lead 178 connected therebetween and the phase sensitive detector or computer 176. The amplifier 162 has a second output lead 182 connected to phase sensitive detector 180. A capacitor 171 and a resistor 173 are connected in series, the common junction point of which is connected by means of a lead 175 to a suitable amplifier 174 having an output connected by a lead 181 to the phase sensitive detector 180. The other end of the resistor 173 is grounded and the other side of the capacitor 171 is connected by means of a lead 172 to the amplifier 82. It will be noted that the coupling networks between amplifiers 73 and 167 namely capacitor 164 and resistor 166 and between the amplifiers 82 and 174 namely the capacitor 171 and the resistor 173 are similar to one another. The resistive and capacitive components are selected so as to produce substantially a 45° phase shift of one sense. The coupling network including the resistor 160 and the capacitor 161 coupling the amplifier 162 and 176 however is different from the first two coupling arrangements in that the positions of the resistors and capacitors have been reversed. Again the values of the resistive and capacitive components are selected so as to produce a 45° phase shift, however, the sense of the shift being opposite to that produced by the networks 164–166 and 171–173. Thus each of the phase sensitive detectors 176 and 180 receives inputs, the phase angle between each of the pairs of inputs being shifted 90° as compared to equivalent inputs to the cosine computers depicted in FIG. 1B.

The output of phase sensitive detector 176 is applied to a connection lead 184 which in turn is connected to a modulator 183. The output of phase sensitive detector 180 is applied to a modulator 193 through a connection lead 186. The modulators 183 and 193 may well be identical to the modulator means 90–93 depicted in FIG. 3. It will be understood that suitable means not shown in FIG. 6 are provided for modulating the unidirectional signal appearing at lead 184 180° out of phase with the unidirectional signal appearing at lead 186. The output from modulator 183 is applied first to the vertical axis input terminal 100*a* of the indicator 100 through a lead 185 and secondly through a lead 191 to a relay means 190. The output of the modulator 193 is applied through a first lead 187 to the horizontal axis input terminal 100*b* of the indicator 100 and secondly through a lead 192 to the relay 190. Relay 190 is shown in block diagram form and may be of any suitable type. It further may be replaced by other suitable means for providing the same function. The primary purpose of the relay 190 is to provide a selective connection means between the modulators 183 and 193 and the intensity control terminal 100*c* of the indicator 100. The leads 191 and 192 leading from the modulators 183 and 193 would be connected to the control means for the relay so as to actuate or control the same at a preselected value so as to establish a connection between the modulators 183 and 193 and the intensity control at some preselected value. The purpose of the relay 190 is to prevent a possible ambiguity presentation in the low altitude mode of operation of the apparatus. It can be shown that in the low altitude mode for horizontal displacements of more than ±1 altitude ambiguities would exist. Accordingly the arrangement depicted in FIG. 6 functions so that the relay 190 is actuated only after it receives signals having a magnitude of a sufficient level generally corresponding to that which would be detected for horizontal displacements of ±. altitude or less so as to complete the connection between the modulators 183 and 193 to the intensity control of the indicator 100. Thus as long as the craft is within the prescribed limits the connection will be completed between the modulators 183 and 193 and the indicator so as to give a positive depiction of the relative bearing of the line to the craft as well as the distance therefrom.

It will be understood that the high altitude mode of operation and the low altitude mode of operation may be selectively used according to the teaching of the present invention. For the high altitude mode of operation the apparatus generally depicted in FIGS. 1B and 3 would be used while for the low altitude mode of operation the apparatus generally depicted in FIG. 6 would be used. Suitable switching arrangements or the equivalent not shown are provided for permitting the use of certain elements to perform in both systems. On the other hand if desired, two completely independent computing arrangements could be used having relatively few if any common components.

As indicated, the present apparatus provides a control system by means of which a dirigible craft may be controlled. In addition to human control, it will be understood that the control system also may be utilized in automatic control. It will be understood by those skilled in the art of automatic control of dirigible craft that the outputs of the computers depicted in FIGS. 3 and 6 can be coupled by conventional means into the control channels of a dirigible craft.

Figure 8:
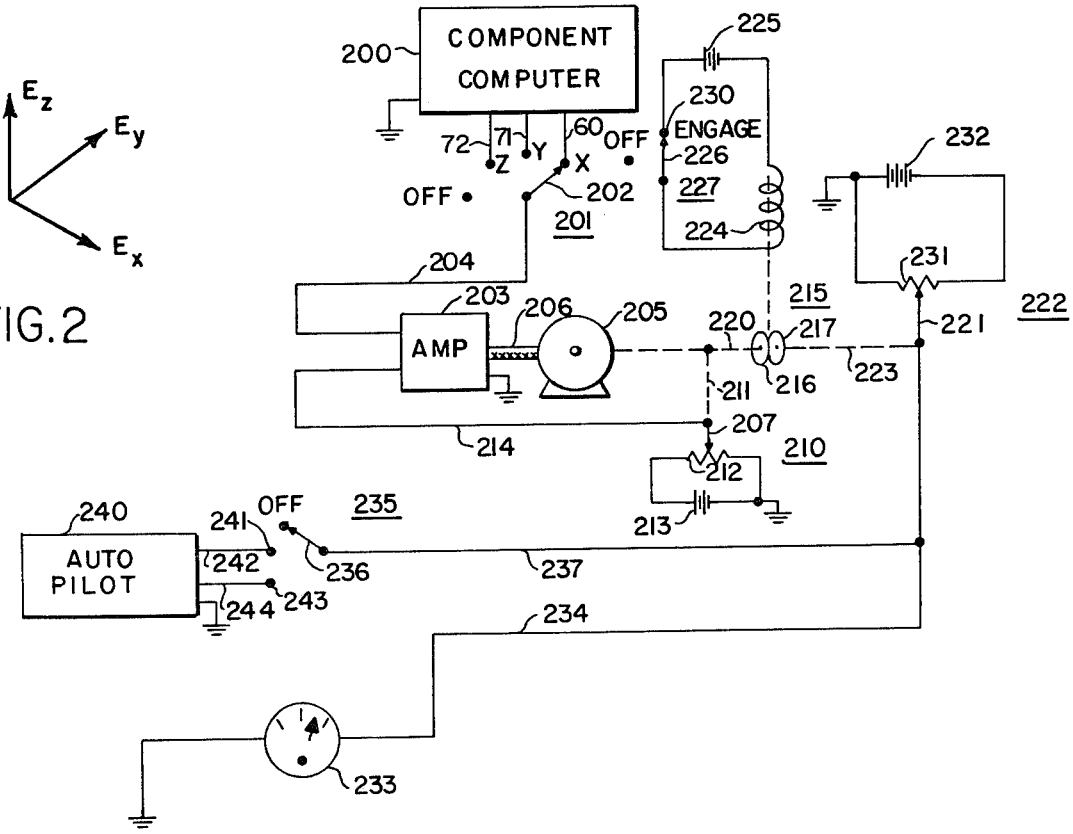
FIG. 8 is a schematic diagram of a steering system for manuevering a dirigible craft relative to a transmission line.

In addition in FIG. 8 a special control arrangement is provided for automatically steering a dirigible craft. In FIG. 8 a component computer identified by the reference numeral 200 may well be generally of the type depicted in FIG. 1A wherein signals representative of three orthogonal components of the electric field are sensed and produced and are applied through suitable connection leads such as leads 60, 71 and 72 to three fixed contacts X, Y and Z of a selector switch 201 having a movable selector arm 202 adapted to be either in an off position or in engagement with one of the contacts X, Y and Z. Selector switch arm 202 is connected through a lead 204 to a suitable amplifier 203, the output of which is connected through a suitable lead 206 to a servomotor 205. The servo 205 is adapted to provide a mechanical output schematically represented by a shaft member 220 which is connected to a driving part 216 of a clutch element 215, the driven element 217 of which is connected through a suitable mechanical connection 223 to the wiper arm 221 of a potentiometer 222 also comprising a resistive portion 231. A coil 224 when energized is adapted to complete the connection between the driving part 216 and the driven part 217 of the clutch 215. The energization of the coil 224 is controlled by a two position switch 227, the contact arm 226 of which can either be in an off position or an engage position at which point it is in engagement with a fixed contact 230 which is connected to one side of a source of energization 225, the other side of which is connected to one side of the coil 224, the other side of the coil 224 is connected to the switch arm 226. The output of the servomotor 225 is also connected through a suitable mechanical connection 211 to drive the wiper 207 of a potentiometer 210 having a resistive portion 212. A source of energization 213 is connected across the ends of resistor 212. The wiper arm 207 of potentiometer 210 is connected by means of a lead 214 to a second input of the amplifier 203. The signal applied to amplifier 203 from the component computer 200 serves to actuate the motor 205. Actuation of the motor 205 causes a relative movement between the wiper 207 and the resistor 212 of the potentiometer 210 so as to produce a rebalance signal which will tend to null out the applied signal from the component computer 200. If it is desired to control the dirigible craft then the engage switch 227 will be displaced to the engage position so as to energize the coil 224 and complete the connection between the driving part 216 and the driven part 217 of the clutch 215. This enables the rotation of movement of the motor 205 when actuated to cause relative movement between the wiper 221 and the resistor 231 of the potentiometer 222. A control signal produced thereby is applied through a lead 234 to a suitable indicator 233 and also through a lead 237 to a movable contact arm 236 of a three-position selector switch 235. The selector switch includes a pair of fixed contacts 241 and 243 which are adapted to be engaged by the movable contact arm 236 in two of its positions. An autopilot of any suitable type is schematically represented by a block 240 and a yaw axis channel thereof not specifically shown is adapted to receive the input signal through a lead 242 which is connected to terminal 241 of the selector switch 235. Further, the autopilot includes a pitch channel not specifically shown adapted to receive an input through a lead 244 which in turn is connected to the fixed contact 243 of the selector switch 235. The apparatus depicted in FIG. 8 may be used for heading control or may be used for altitude control depending upon positions of the switches 201 and 235. Assuming that altitude control is desired, then selector switch 201 would be connected to the Z terminal connected to the component computer 200. The motor 205 would be energized as a function of the Z signal to drive wiper 207 to a position at which a rebalance signal would be applied to the amplifier 203 to null out the particular signal level representative of the vertical component of the electric field at that altitude. At that time the coil 224 controlling the clutch 215 would be energized so as to couple any subsequent movement of the motor 205 to the wiper 221. Thus as long as the aircraft remains at the altitude that it had at the time of engagement of the clutch 215 there will be no relative movement between the wiper 221 and the resistor 231 of the potentiometer 222. However, if there is a deviation in altitude then the Z signal will change so as to unbalance the amplifier 203 and drive the motor 205. This would produce a signal at potentiometer 222 which in turn would give a visual indication on meter 233 due to the fact that wiper 221 would now be moved away from its null signal producing position with respect to resistor member 231. Switch 235 would have been previously operated so that movable switch arm 236 was connected through fixed contact 243 associated with the pitch channel of the autopilot. Accordingly the signal produced at potentiometer 222 would be coupled into the autopilot 240 so as to provide a controlling action through the autopilot to the dirigible craft so as to tend to bring the craft back to its initial altitude.

In the same manner if the apparatus depicted in FIG. 8 were desired to maintain a particular craft heading then one of the signals from the component computer 200 could be used as a reference. The selector switch 235 would be actuated so that the movable contact arm 236 thereof engaged the yaw axis contact 241 associated with the yaw channel of the autopilot and the switch arm 202 of the switch 201 could be connected to either the X or the Y or the Z output terminals of the component computer 200. Once a particular heading had been established so that the amplifier 203 was nulled out by virtue of a rebalance signal being produced at potentiometer 210 and applied to the amplifier through lead 214, then the clutch 215 could be engaged and the apparatus thereafter would function to maintain that particular heading. It will be understood that any deviation in heading would tend to cause a change in the value of the particular component being sensed and computed by the component computer so as to change the balance of the amplifier 203 and accordingly actuate the motor 205 to produce an output signal at potentiometer 202 which would be coupled through lead 237 to the autopilot 240. Simultaneously there would be a visual presentation on the indicator 233. This apparatus is advantageously used when it is desired to control the dirigible craft on a heading parallel to a transmission line but not directly overhead. The particular aircraft heading is selected at a horizontal displacement from the line and the apparatus will function thereafter to maintain the craft on a heading parallel to the line the horizontal displacement remaining the same.

Line anomalies such as line terminations, line transpositions, line crossings, and turns each have their own characteristic electric field configurations. The apparatus above described is effective to control dirigible craft with respect to such anomalies.

While we have shown specific embodiments of the invention, it will be understood that it is not limited to the particular forms shown and we intend that the appended claims cover all modifications which do not depart from the spirit and scope of the invention.

We claim:

1. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and the cosine of the relative phase angle therebetween; modulation means connected to said first network and adapted to modulate the unidirectional signal thereof to produce a first modulated signal, and connected to said second network and adapted to modulate the unidirectional signal thereof 180° out of phase with the modulation of said first modulated signal to produce a second modulated signal; cathode ray indicator means including first and second beam deflection control input means; and means connecting said network means and said modulation means to said indicator means so that the output signal of the first network and the second modulated signal are applied to said first beam control input means and so that the output signal of the second network and the first modulated signal are applied to said second beam control input means.

2. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and the cosine of the relative phase angle therebetween; modulation means connected to said first network and adapted to modulate the unidirectional signal thereof to produce a first modulated signal, and connected to said second network and adapted to modulate the unidirectional signal thereof 180° out of phase with the modulation of said first modulated signal to produce a second modulated signal; cathode ray indicator means including first and second beam deflection control input means and beam intensity control means; means connecting said network means and said modulation means to said indicator means so that the output signal of the first network and the second modulated signal are applied to said first beam control input means and so that the output signal of the second network and the first modulated signal are applied to said second beam control input means; and means connecting the output means of one of said networks to said beam intensity control means.

3. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and the cosine of the relative phase angle therebetween; modulation means connected to said first network and adapted to modulate the unidirectional signal thereof to produce a first modulated signal, and connected to said second network and adapted to modulate the unidirectional signal thereof 180° out of phase with the modulation of said first modulated signal to produce a second modulated signal; controlled means including first and second control input means; and means connecting said network means and said modulation means to said controlled means so that the output signal of the first network and the second modulated signal are applied to said first control input means and so that the output signal of the second network and the first modulated signal are applied to said second control input means.

4. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and a trigonometric function of the relative phase angle therebetween; modulation means connected to said first network and adapted to modulate the unidirectional signal thereof to produce a first modulated signal, and connected to said second network and adapted to modulate the unidirectional signal thereof 180° out of phase with the modulation of said first modulated signal to produce a second modulated signal.

5. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and the cosine of the relative phase angle therebetween; cathode ray indicator means including vertical input means and horizontal input means; and means connecting said indicator means to said networks so that the network output signals are respectively connected to said vertical and horizontal input means of said indicator means.

6. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and a function of the relative phase angle therebetween.

7. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so that the first and second of said signals are applied to the input means of one of said networks and so that the second and third of said signals are applied to the input means of the other of said networks, each of said networks being characterized by producing a unidirectional output signal the polarity of which is determined by the relative phase angle between the two signals applied thereto and the magnitude of which is determined by the magnitude of the smaller of the two signals applied thereto and a function of the relative phase angle therebetween; cathode ray indicator means including first input means and second input means; and means connecting said indicator means to said networks so that the network output signals are respectively connected to said first and second input means of said indicator means.

8. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said first and second networks so that the first and second of said alternating signals are applied to the input means of one of said first and second networks and so that the second and third of said alternating signals are applied to the input means of the other of said first and second networks, each of said first and second networks being characterized by producing a unidirectional output signal the polarity of which is determined by the relative phase angle between the two alternating signals applied thereto and the magnitude of which is determined by the magnitude of the smaller of the two alternating signals applied thereto and the sine of the relative phase angle therebetween.

9. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of the product of magnitude of the smaller of the signals applied thereto and a trigonometric function of the phase angle between the signals applied thereto; indicator means comprising at least two input means; and means connecting said network output means respectively to said indicator input means.

10. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of the product of magnitude of the smaller of the signals applied thereto and a trigonometric function of the phase angle between the signals applied thereto; and means connected to said network output means to receive the output signals thereof and adapted to supply a control signal indicative of a function of said output signals.

11. In a control system by means of which a dirigible craft may be controlled, means on said craft for detecting electric fields through which said craft may be moving and for producing three signals indicative of orthogonal components of the electric field detected thereby; first and second computing networks each comprising input means and output means; means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of a function of the input signals applied thereto; and means connected to said network output means to receive the output signals thereof and adapted to supply a control signal indicative of a function of said output signals.

12. In a control system by means of which a dirigible craft may be controlled, means on said craft for detecting electric fields through which said craft may be moving and for producing three alternating signals indicative of the orthogonal components of the electric field detected thereby; first and second computing networks each comprising input means and output means; means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of the product of magnitude of the smaller of the signals applied thereto and the cosine of the phase angle between the signals applied thereto; indicator means comprising at least two input means; and means connecting said network output means respectively to said indicator input means.

13. In a control system by means of which a dirigible craft may be controlled, means on said craft for detecting electric fields through which said craft may be moving and for producing three signals indicative of orthogonal components of the electric field detected thereby; first and second computing networks each comprising input means and output means; and means connecting said detecting and signal producing means to said networks so the first and second of said signals are applied to the input means of one of said networks and so that the second and third of said signals are applied to the input means of the other of said networks, said networks being characterized by producing output signals at the output means thereof indicative of the product of magnitude of the smaller of the signals applied thereto and a trigonometric function of the phase angle between the signals applied thereto.

14. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said first and second networks so that the first and second of said alternating signals are applied to the input means of one of said first and second networks and so that the second and third of said alternating signals are applied to the input means of the other of said first and second networks, each of said first and second networks being characterized by producing a unidirectional output signal the polarity of which is determined by the relative phase angle between the two alternating signals applied thereto and the magnitude of which is determined by the magnitude of the smaller of the two alternating signals applied thereto and the cosine of the relative phase angle therebetween; third and fourth computing networks each comprising input means and output means; means connecting said detecting and signal producing means to said third and fourth networks so that the first and second of said alternating signals are applied to the input means of one of said third and fourth networks and so that the second and third of said alternating signals are applied to the input means of the other of said third and fourth networks, each of said third and fourth networks being characterized by producing a unidirectional output signal the polarity of which is determined by the relative phase angle between the two alternating signals applied thereto and the magnitude of which is determined by the magnitude of the smaller of the two alternating signals applied thereto and the sine of the relative phase angle therebetween; modulation means connected to said third network and adapted to modulate the unidirectional signal thereof to produce a first modulated signal, and connected to said fourth network and adapted to modulate the unidirectional signal thereof 180° out of phase with the modulation of said first modulated signal to produce a second modulated signal; cathode ray indicator means including first and second beam deflection control input means; and means connecting said network means and said modulation means to said indicator means so that the output signal of the first network and the second modulated signal are applied to said first beam deflection control input means and so that the output signal of the second network and the first modulated signal are applied to said second beam deflection control input means.

15. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said first and second networks so that the first and second of said alternating signals are applied to the input means of one of said first and second networks and so that the second and third of said alternating signals are applied to the input means of the other of said first and second networks, each of said first and second networks being characterized by producing a unidirectional output signal the polarity of which is determined by the relative phase angle between the two alternating signals applied thereto and the magnitude of which is determined by the magnitude of the smaller of the two alternating signals applied thereto and the cosine of the relative phase angle therebetween; third and fourth computing networks each comprising input means and output means; means connecting said detecting and signal producing means to said third and fourth networks so that the first and second of said alternating signals are applied to the input means of one of said third and fourth networks and so that the second and third of said alternating signals are applied to the input means of the other of said third and fourth networks, each of said third and fourth networks being characterized by producing a unidirectional output signal the polarity of which is determined by the relative phase angle between the two alternating signals applied thereto and the magnitude of which is determined by the magnitude of the smaller of the two alternating signals applied thereto and the sine of the relative phase angle therebetween; modulation means connected to said third network and adapted to modulate the unidirectional signal thereof to produce a first modulated signal, and connected to said fourth network and adapted to modulate the unidirectional signal thereof 180° out of phase with the modulation of said first modulated signal to produce a second modulated signal; cathode ray indicator means including first and second beam deflection control input means and beam intensity control means; means connecting said network means and said modulation means to said indicator means so that the output signal of the first network and the second modulated signal are applied to said first beam deflection control input means and so that the output signal of the second network and the first modulated signal are applied to said second beam deflection control input means; and means for connecting said modulation means to said beam intensity control means.

16. In a control system by means of which a dirigible craft may be controlled, means on said craft for detecting electric fields through which said craft may be moving and for producing three alternating signals indicative of orthogonal components of the electric field detected thereby; first and second computing networks each comprising input means and output means; means connecting said detecting and signal producing means to said first and second networks so that the first and second of said alternating signals are applied to the input means of one of said first and second networks and so that the second and third of said alternating signals are applied to the input means of the other of said first and second networks, each of said first and second networks being characterized by producing a unidirectional output signal the polarity of which is determined by the relative phase angle between the two alternating signals applied thereto and the magnitude of which is determined by the magnitude of the smaller of the two alternating signals applied thereto and the cosine of the relative phase angle therebetween; third and fourth computing networks each comprising input means, phase shifting means, and output means; means connecting said detecting and signal producing means to said third and fourth networks so that the first and second of said alternating signals are applied to the input means of one of said third and fourth networks and so that the second and third of said alternating signals are applied to the input means of the other of said third and fourth networks, each of said third and fourth networks being characterized by producing a unidirectional output signal the polarity of which is determined by the relative phase angle between the two alternating signals applied thereto and the magnitude of which is determined by the magnitude of the smaller of the two alternating signals applied thereto and the sine of the relative phase angle therebetween; modulation means connected to said third network and adapted to modulate the unidirectional signal thereof to produce a first modulated signal, and connected to said fourth network and adapted to modulate the unidirectional signal thereof 180° out of phase with the modulation of said first modulated signal to produce a second modulated signal; cathode ray indicator means including first and second beam deflection control input means and beam intensity control means; means connecting said network means and said modulation means to said indicator means so that the output signal at the first network and the second modulated signal are applied to said first beam deflection control input means and so that the output signal of the second network and the first modulated signal are applied to said second beam deflection control means; and selective connection means connecting said modulation means to said beam intensity control means and adapted to apply a signal from said modulation means to said beam intensity control means upon a predetermined signal being applied to said connection means.

* * * * *